United States Patent [19]

Cardwell et al.

[11] 4,137,291

[45] Jan. 30, 1979

[54] EXTRACTION OF METAL VALUES FROM MANGANESE NODULES

[75] Inventors: Paul H. Cardwell, Zanoni; William S. Kane, Wicomico, both of Va.

[73] Assignee: Deepsea Ventures, Inc., Gloucester, Del.

[21] Appl. No.: 733,214

[22] Filed: Oct. 18, 1976

[51] Int. Cl.[2] ..... C01G 3/14; C01G 51/12; C01G 53/12

[52] U.S. Cl. ..... 423/24; 423/32; 423/50; 423/139; 423/150; 423/DIG. 4; 423/143

[58] Field of Search ..... 423/24, 32, 33, 49, 423/139, 150, 143, 144, 50; 75/103, 117, 119, 21, 101 BE, 80; 204/105

[56] References Cited

U.S. PATENT DOCUMENTS

| | | | |
|---|---|---|---|
| 318,603 | 5/1885 | Deumelandt | 423/50 |
| 1,932,413 | 10/1933 | Laury | 423/50 |
| 2,042,814 | 6/1936 | Vadner | 423/50 |
| 2,296,841 | 9/1942 | Gardner | 423/49 |
| 2,608,463 | 8/1952 | Dean | 423/50 |
| 2,822,263 | 2/1958 | Forward | 75/117 |
| 3,397,130 | 8/1968 | Brantley et al. | 204/105 |
| 3,471,285 | 10/1969 | Rolf | 75/115 |
| 3,734,415 | 5/1973 | Redman | 75/119 |
| 3,907,966 | 9/1975 | Skarbo | 423/139 |
| 3,988,224 | 10/1976 | Barriere | 423/24 |

*Primary Examiner*—Brian Hearn
*Attorney, Agent, or Firm*—Barry G. Magidoff

[57] ABSTRACT

This invention provides a two-stage leaching procedure for manganese nodules for obtaining directly in one leaching stage the metal values other than manganese in one ammoniacal aqueous solution. The manganese nodules are reduced and then leached initially utilizing a solution of an ammonium salt, e.g., ammonium sulfate, to selectively leach out the manganese value, followed by a second stage leaching with an ammoniacal solution, to leach out the nickel, cobalt and copper values. The nickel, cobalt and copper values can then be individually separated from the second leach solution by liquid ion exchange extraction.

16 Claims, 3 Drawing Figures

EXTRACTION OF METAL VALUES FROM MANGANESE NODULES

It is not a common situation to obtain a relatively valuable non-ferrous metal such as nickel, cobalt, copper and zinc together with a relatively large proportion of manganese and a significant quantity of iron. A relatively untapped source of high-quality manganiferous ore, however, is a material which is found on the ocean floor and has come to be known as ocean floor nodule ore, or manganese nodule ore.

With the increased awareness on the part of both the public and the metals industry of the ecological dangers that can arise from continued surface mining of minerals required for most ores mined from the land, as well as the recent diminution in the availability of valuable industrial ores, the mining industry has become interested within the last several years in the mining of minerals from the sea. This has been an extremely elusive target up to the present. One method of obtaining such minerals has been the dredging of the deep ocean floor to obtain an ore which has variously become known as ocean floor nodule ores, manganese nodules or merely nodules. Such minerals can be merely scooped up from the top surface of the ocean floor without requiring a rending of the earth's surface.

The nodule ore was first collected during the first part of the 1870's. Deposits of this ore are found as nodules, lying on the surface of the soft sea floor, as large slabs on the ocean floor, or as replacement fillings in calcareous debris and other animal remains. They have been studied by many workers in an attempt to determine their precise composition, and then to decipher ways to wrest from their peculiar structure the valuable metals contained therein. It is presently believed that these nodules are actually creations of the sea; they are somehow grown, generally in the form of the metal oxides, from metal values which are dissolved in sea water.

The metal values of the nodules are almost exclusively in the form of oxides and moreover are present in extremely peculiar physical configuration. The physical and chemical structure of the nodules are believed to be a direct result of the conditions under which they were created and to which they have been exposed since their creation. First, nodule ore has never been exposed to temperatures other than those at the bottom of the ocean at the location at which they were formed. The nodule ores have an extremely large surface area, a porosity often greater than 50%, and are relatively chemically reactive ores. The solid structure of the nodules is extremely complex, seemingly formed of many crystalites, but without any recognizable overall crystalline pattern or structure. The nodules are formed basically of what appears to be an extremely complex arrangement, or matrix, of iron and manganese oxides: tiny grains of each oxide of a size and type which are substantially impossible to separate by presently available physical means. These iron and manganese oxides form the basic structure within which other metal values are retained, in what is believed to be at least partially a result of a substitution mechanism. These other metal values include, as the major ingredient, nickel, copper and cobalt, and in addition, chromium, zinc, tin, vanadium and other metals, including the rare metals, silver and gold.

In addition to the metal oxides, described above, there is also present a large quantity of silt, or gangue material, intimately admixed with the nodule ore. This silt, or gangue, is sand and clay, and includes the usual oxides of silicon and aluminum and varying proportions of some carbonates, especially calcium carbonate.

The precise chemical composition, as well as the physical structure, of the nodules vary somewhat depending upon their location in the ocean. Variation is perhaps caused by differences in temperature in various places, and at different depths, differences in the solute composition of sea water, perhaps caused by the pressure variations at different depths and the composition of adjacent land areas, variations in the amount of oxygen which is present in the water in different locations, and perhaps other variables not readily apparent to observers. Generally, however, in almost all cases, the metals which are present in primary proportions are manganese and iron, and the predominant secondary metals are generally nickel, copper and cobalt. A detailed analysis of a variety of different nodule ores can be found in an article entitled "The Geochemistry of Manganese Nodules and Associated Deposits From the Pacific and Indian Oceans" by Croonan and Tooms, in *Deepsea Research* (1969), Volume 16, pages 335–359, Pergamon Press (Great Britain).

As a general rule, the nodule ores can be considered as containing the following metal content ranges, derived on a fully dry basis.

| | Percent |
|---|---|
| Copper | 0.8 - 1.8 |
| Nickel | 1.0 - 2.0 |
| Cobalt | 0.1 - 0.5 |
| Manganese | 10.0 - 40.0 |
| Iron | 4.0 - 25.0 |

Because of the peculiar and intricate crystal structure of the ocean floor nodules, many of the common refining techniques used for the refining of land ores are not generally suited for the nodules. Most especially, because of the great value attached to the nickel and copper values in the manganese nodules, and the relatively large amounts of manganese found in these ores, special procedures are needed, which are not relevant to terrestrial ores, for the refining of these materials.

Among the procedures is included the reduction of pellets prepared from manganese deepsea nodules, to form metallic copper, nickel and cobalt, within the pellets, followed by leaching with an ammoniacal ammonium salt solution to obtain the copper, nickel and cobalt salts in solution without dissolving any manganese or iron. The leaching is carried out in the presence of aeration, see U.S. Pat. Nos. 3,788,841 and 3,741,554.

Nodule ores have also been treated by two-phase leaching utilizing ammoniated ammonium salt solutions, wherein the temperatures vary, to initially extract copper under milder, room temperature conditions, and subsequently to extract nickel under higher temperatures (U.S. Pat. No. 3,736,125). A selective reduction of the manganese nodules permits the selective leaching of copper, nickel, cobalt and molybdenum, without the leaching of manganese, according to U.S. Pat. No. 3,734,715, while the partial reduction of a nodule ore charge, when utilizing an ammonia solution also containing manganous ions, permits the leaching of copper, nickel, cobalt and molybdenum (U.S. Pat. No. 3,723,095).

In a somewhat different direction, manganese has been extracted from terrestrial manganiferous ores, which have not contained cobalt, copper and nickel, utilizing acidic ammonium salts, such as ammonium sulfate, see "*Review of Proposed Processes for Recovering Manganese From United States Resources, Part 2-Chloride and Fixed Nitrogen Processes*", Bureau of Mines, Information Circular No. 8160 (1963, U.S. Dept. of Interior), pages 26–28.

A problem with the previously carried out procedures for separating the manganese metal value from the other metal values in the ocean floor nodule ore is the problem of extracting at least a minor proportion of the manganese together with the other metal values, when the metal values are initially extracted. Because of the order of magnitude difference between the amount of manganese and the amount of, e.g., nickel and copper, present in the ocean floor nodule ores, even a minor extraction of manganese results in a significant dilution of the nickel/copper concentration in the solution. It is, accordingly, an object of the present invention to avoid this problem and enable the art to obtain a relatively pure leach solution containing the valuable nickel and copper values, as well as the desirable cobalt value, and a separate leach solution containing the manganese metal value. It is further an object of this invention to provide a continuous process for individually obtaining the metal values wherein each leaching solution can be recovered and recycled for further use.

In accordance with the present invention, there is provided a process for selectively removing metal values from a manganese nodule ore, the ore comprising primary proportions of manganese and iron and secondary proportions of nickel, copper and cobalt. Most preferably, the ore contains a manganese : iron ratio of at least about 5:1 and optimally at least about 6:1, and a total proportion of copper, nickel and cobalt of at least about 1.5% by weight. The process comprises the steps of: (a) reducing the manganese nodule ore; (b) leaching the reduced ore with an aqueous solution of an acidic ammonium salt, to selectively dissolve out the manganese value from the ore so as to obtain an initial aqueous leach solution comprising dissolved manganese salt, and a solid leached ore; and (c) releaching the solid leached ore with an ammoniated aqueous solution of an ammonium salt to dissolve out the copper, cobalt and nickel values from the ore, so as to form an aqueous releach solution comprising dissolved nickel, cobalt and copper salts, and a solid final residue, wherein the reduced or leached ore is permitted to be oxidized prior to completion of the releaching so that the cobalt, nickel and copper values are in a soluble condition.

In a preferred embodiment of this process, the pregnant releach solution is then further treated to separate the individual metal values by treating the remaining aqueous solution with a liquid ion exchange agent so as to separate the cobalt, nickel and copper values into separate streams thereof, by selective extraction.

In accordance with this process, the nodule ore is preferably initially dried and the reduction carried out under anhydrous conditions. The drying can be carried out in the same or a separate stage, at temperatures substantially below the reduction temperatures. The drying temperatures are preferably no greater than about 250° C. and most preferably at temperatures in the range of from about 150° C. to about 250° C.

In order to increase the rates of drying and subsequent reduction and leaching of the nodule ore, the ore is preferably initially comminuted, as by grinding and crushing to a particle size of not greater than about 20 mesh, U.S. Sieve Scale, most preferably not greater than about 50 mesh and optimally not greater than about 100 mesh.

The dried and comminuted nodule ore is next reduced preferably at a temperature of at least about 300° C. The reduction is most easily and economically carried out by reacting the nodule ore with a carbonaceous or hydrogen-containing reducing agent, which is itself oxidized to either carbon dioxide or water vapor when the metal values are reduced.

The intent of this reducing step is to convert the metal values in the nodule ore into forms which are readily leachable by the ammonium salt solutions described herein. It has been found that the nodule ore as obtained from the ocean floor, and even after drying, is not readily susceptible to leaching utilizing the ammonium salt solutions of the present invention. After reduction, however, it has been found that the metal values can be readily dissolved into an ammonium salt solution, the need for free additional ammonia being dependent upon the particular metal to be dissolved. The reduction to be carried out in accordance with the present step of the process of this invention should result in substantially all of the manganese originally present in the ore in the tetravalent state to be reduced to the divalent state. Concurrently with the reduction of the manganese, there must, almost of necessity, be a reduction of the nickel, cobalt and copper values present in the ore. Although it is not clear to exactly what valence state the nickel, cobalt and copper are reduced, it is generally believed that they are reduced to a state below that at which they are found in the ore. Without being limited thereto, it is believed that the copper is reduced to the elemental state and the nickel and cobalt are reduced to some other state, perhaps one intermediate the common divalent and elemental states.

It has been found that any iron value will also generally be reduced to a state below that in which it is normally found, and that at least part of the iron is reduced to a state where it is not leached out together with the manganese value in accordance with the first leaching step of the present invention. This, what is in effect, limited reduction of the iron is desirable to decrease the iron dissolved in the initial leach solution so as to minimize the problems of subsequent separation of iron from manganese in the first leach solution. Generally, the relative proportion of manganese and iron in the nodule ore is somewhat too rich in iron to obtain a valuable commercial product if all the iron were to be leached out in the same proportion as the manganese.

The nickel, cobalt and copper are generally believed to be suitably re-oxidized, if necessary, to a soluble state by simple aeration (or even mere exposure to the atmosphere). The exact mechanism by which the various metal values are reduced or oxidized, and even the valence states to which they are reduced or oxidized, have not been precisely determined, but need not be known for the satisfactory carrying out or regulation of the process of the present invention.

Although the scope of this invention should not be limited thereto, it is believed that generally any reducing agent which has sufficient reducing strength to reduce tetravalent manganese to divalent manganese and to reduce the other metal values in the ore can be utilized for the reducing stage of this invention. It should, of course, be noted that the reducing agent need not be a pure compound or element and that a combination of two or more reducing agents can be utilized. For example, many natural products, such as hydrogen, natural gas or coal, or manufactured gas, e.g., producer gas, contains a combination of compounds or elements at least some of which provide at least some reducing action with regard to the metal values in the nodule ore. Generally, elemental carbon in any physical state, including amorphous or graphitic carbon, or natural or semi-manufactured solid carbonaceous materials, such as coal, peat, charcoal, and coke, can be used. Oil or other organic sources can be utilized as a source for the reducing action of carbon, and any hydrocarbon can be used: aromatic, aliphatic or cycloaliphatic, or compounds having combinations of these groups, without interfering with the reducing action. Solid hydrocarbon compounds, especially the higher condensed ring aromatic materials, including most especially those derived from petroleum or other natural mineral products which are often available as by-product tars from the refining of these materials, have the highest proportion of carbon among the hydrocarbons, and, therefore, provide a desirable unit weight effectiveness as a solid reducing agent. Gaseous materials, such as carbon monoxide, alone or admixed with hydrogen, as in reformer gas, can also be readily utilized as reducing agents. As stated earlier, hydrogen itself is a strong and effective reducing agent, and, if available cheaply enough, can be used commercially.

Generally, the most efficient temperature, or temperature range, for the reduction reaction is dependent upon the reducing agent utilized. The reducing agents, which are most effective in reducing tetravalent manganese to the divalent state, and which also can reduce the other metal values present, at temperatures as low as about 300° C. in accordance with this procedure, include normally gaseous materials such as hydrogen and carbon monoxide, and synthetic mixtures thereof. Other fluid reducing agents, such as, for example, the lower, gaseous or liquid, hydrocarbons, which are somewhat less effective in reducing manganese and the other metal values, should be used at somewhat higher temperatures of at least about 500° C. Generally, the solid reducing agents, such as elemental carbon, e.g., coal, or the higher solid hydrocarbons, would be utilized at higher temperatures of at least about 550° C.

Generally, for a given reducing agent, the higher the temperature of reaction, the shorter should be the reaction time, in order to avoid over-reduction of the ore. In any event, generally, a temperature greater than about 850° C. is unnecessary and introduces difficulties in the subsequent leaching steps, so that preferably temperatures in the range of from about 350° C. to about 800° C. are preferred, but optimally, temperatures not greater than about 750° C. are utilized.

The reduction of the nodule ore can be carried out on a batch or a continuous basis. The time of reaction is substantially the same and is measured as "residence time," for either basis. The reduction reaction time, or residence time, is generally maintained at from about 0.5 to about 3 hours, and preferably 0.75 to about 1.75 hours.

The reduced ore is next subjected to an aqueous leaching, utilizing an aqueous solution of an acidic ammonium salt. The divalent manganese value present in the reduced ore has been found to be selectively leached by this ammonium salt, substantially without leaching of the other metal values, specifically nickel, copper and cobalt. The ammonium salt in the leaching solution, it is believed, reacts with the divalent manganese oxide in the reduced ore to form the corresponding soluble salt of manganese and dissolved ammonia, or ammonium hydroxide. Although the scope of this invention is not to be limited thereto, it is believed that the leaching reaction proceeds in accordance with reaction equation 1, below, which utilizes ammonium sulfate as the example of the leaching ammonium salt:

$$MnO + H_2O + 2NH_4^+ + SO_4^= \rightarrow Mn^{++} + SO_4^= + 2NH_4OH \qquad \text{I.}$$

It has been found, surprisingly, that the reaction will proceed rapidly towards dissolution of the manganese metal value, even without the continuous evolution of free ammonia from the liquid. Although the leaching reaction does occur at substantially ambient temperatures, the first leaching step is preferably carried out at a temperature of at least about 75° C., most preferably about 85° C. up to just below the boiling point, and optimally in the range of from about 85° C. to about 95° C. It has been found that free ammonia is not evolved in any substantial quantities from the leach liquid unless the liquid is actually boiling, under the usual conditions of leaching.

The leaching liquid should contain a substantially stoichiometric amount of the ammonium salt to react with the manganese oxide in accordance with the above equation. Though it is recognized that a stoichiometric quantity is optimum, it is also recognized that maintaining a precise stiochiometric relationship between the leaching liquid and the ore is difficult if not impossible on a practical basis. Accordingly, it has been found that preferably the leaching liquid contain plus or minus 20% by weight of the stoichiometric amount of the ammonium salt and optimally plus or minus 10% of the stoichiometric amount. By maintaining the ratio of the leaching ammonium salt and the manganese ore as close as possible to the stoichiometric proportions, the dissolution of the nickel, cobalt and copper values into this first leach solution is held down. By maintaining the proportion of the ammonium salt and the ore within at least 20% of the precise stoichiometric ratio, the solution of the other metal values is substantially avoided, and it is for this reason that the closer the ratio is to the stoichiometric quantities the more selective is the leaching in accordance with the present process for manganese value. The concentration of the ammonium salt in the leach liquid is not critical, though it is preferred that a too-low concentration be avoided in order to avoid the high cost of treating a relatively large volume of liquid in order to obtain a given amount of manganese solute and a too-high concentration of the ammonium salt would interfere with the leaching of the manganese value.

The leaching liquid can be an aqueous solution of an ammonium salt which can react with manganese to form a soluble manganese salt. Generally useful such salts the the ammonium salts of anions selected from the group consisting of the halides, especially chloride, bromide and iodide, nitrate, and sulfate. The anions can be present alone or in combination, and other anions can be present as long as they do not form insoluble manganese salts.

The leach solution containing the dissolved manganese salt is separated from the leached ore. The manganese salt solution can then be further treated so as to obtain the desired manganese metal. The leach liquid can contain in addition to the dissolved manganese most of that portion of the iron in the reduced ore which was reduced to a leachable state. The solution can be substantially free from nickel, cobalt and copper values, especially when the leaching was carried out under near stoichiometric conditions, as defined above. As pointed out above, however, the proportion of iron present in the leach solution, relative to the proportion of manganese, is sufficiently low such that a mixture of iron and manganese ultimately to be obtained from the leach liquid does provide a commercially valuable ferromanganese product.

A solid manganese salt, generally admixed with an iron salt, can be obtained from the leach liquid by a variety of methods, including precipitation and crystalization. Manganese value can be caused to precipitate by merely oxidizing the manganese value in the solution or by sparging of the ammonia; for example, by merely aerating the solution, preferably at a temperature not greater than about 75° C., and as low as room temperature, manganese and iron are oxidized and the ammonia sparged, resulting in a precipitate of the desired manganese and iron oxides, or hydroxides. The oxidation results in the formation of an insoluble, higher valence manganese compound and ferric hydroxide, or the oxyhydroxides. This method of recovering the manganese and iron values also results in a regeneration of the leaching liquid to form the corresponding ammonium salt; following separation of the manganese and iron precipitate from the aqueous solution, the aqueous solution can then be recycled for further use as a leaching liquid on fresh ore. Alternatively, the manganese and iron values can be precipitated utilizing, for example, an ammonium salt of an anion which forms a water-insoluble salt of manganese, for example, ammonium carbonate or ammonium phosphate. Salts other than the ammonium salts of these insolublizing anions can be utilized, such as, for example, the sodium salts. However, the ammonium salts are preferred as it avoids the introduction of undesirable additional cations.

The manganese, as well as the iron, precipitate can be separated from the regenerated ammonium leach solution by any conventional methods, including, for example, filtration. The separated precipitate can then be dried and preferably decomposed to the oxides at elevated temperatures by known means.

Oxidation of the manganese and iron can be carried out in addition to the simple aeration methods by utilizing a halogen, for example, elemental chlorine or bromine, as well as other strong oxidizing agents, for example, a permanganate.

The solid leached ore from the first leaching step can then be releached in accordance with the present invention utilizing as the releaching solution an ammoniated ammonium salt solution. It has been found, when carrying out this procedure, that the leached ore should be permitted to be at least partially reoxidized in order to improve the dissolution of the metal values of nickel, copper and cobalt. It has been found to be sufficient to merely permit the leached ore to contact the atmosphere and, further, to aerate the releach solution before separation from the remaining solid residue to ensure that all of the metal values have been reoxidized to their soluble state.

The releaching solution can be an aqueous solution of ammonium hydroxide and an ammonium salt. The mechanism for the leaching of the nickel, copper and cobalt is believed to be similar in each case and to result in the formation of a soluble ammoniated metal complex of each of the aforesaid metal values in the solution. The ammonium salt can contain any anion which forms a water-soluble compound with the ammoniated metal complex. Suitable ammonium salts include the halides, especially chloride, bromide and iodide, nitrate, sulfate, and, preferably, the carbonate. The ammoniated metal carbonate salts are water-soluble, although the corresponding simple carbonate salts may not be water-soluble. Without limiting the scope of this invention, it is believed that the leaching reaction proceeds in accordance with the mechanism set forth in the reaction equation II, utilizing nickel and ammonium carbonate as examples:

$$NiO + H_2O + 2NH_4^+ + CO_3^= + yNH_3 \rightarrow Ni(NH_3)_y^{++} + CO_3^= + 2NH_4OH \qquad \text{II}$$

Preferably, the ammonium salt is present in at least a substantially stoichiometric amount to react with and dissolve all of the remaining metal values in the ore. Generally, the ore contains small amounts of metal values other than nickel, cobalt, and copper, as described above, including, for example, molybdenum, which would also be dissolved in accordance with the present leaching reaction. However, the amounts of such materials are relatively small, and a small excess of the stoichiometric amount required to dissolve the nickel, copper and cobalt is sufficient to dissolve all those materials. The concentration of the ammonium salt in the releaching solution is preferably not less than about 0.25 Normal.

The quantity of ammonia dissolved in the releaching solution is limited by that amount needed to cause the solution of the desired metal values, and especially nickel, copper and cobalt. The precise ammonia/metal complex which is formed with each of the metal values is not definitely known. Without seeking to limit the scope of this invention, the mols of ammonia per gram-atom of metal dissolved in the releaching solution is believed to be in the range of from about 3 to about 5. It has been found that the concentration of the releaching liquid should be at least about 0.5 molar ammonia and generally greater than about 10 molar has been found to be unnecessary, and may even be undesirable in resulting in dissolution of unwanted manganese in the solution. Similarly, the maximum amount of the ammonium salt is not critical, but generally greater than about 3.3 mols/liter of the ammonium salt has been found to be unnecessary and therefore undesirable.

The releach solution is a relatively pure solution of the three valuable metal values from the ore i.e., nickel, cobalt and copper, together with a relatively smaller proportion of other valuable metal values, including for example, chromium, vanadium and molybdenum. The relatively pure solution of the nickel, cobalt and copper salts can then be treated in a variety of ways to obtain the individual metal values in a pure state.

One preferred method of separating the individual nickel, cobalt and copper values from the solution is by liquidion exchange procedures. One such liquidion exchange procedure for separating nickel from cobalt, is shown, for example, in U.S. Pat. No. 3,276,863. This procedure is especially effective when the ammonium salt is the carbonate.

In one example of such a procedure, an ammoniacal solution of nickel, cobalt and copper is initially aerated to ensure that all of the cobalt has been oxidized to the trivalent state. This can generally be accomplished for example, by passing air through the solution, especially at elevated temperatures. The solution is then contacted with a water-insoluble organic solution of a liquid ion exchange agent, such as an alpha-hydroxy oxime, or a 7-hydrocarbon-substituted-8-hydroxyquinoline. The copper values are first selectively extracted into the organic solution so that when the organic and aqueous solutions are separated, the first aqueous raffinate comprises a solution of nickel and cobalt salt, substantially free of copper salt, and the organic solution contains copper, substantially free of nickel and cobalt value. The cobalt and nickel can be subsequently separated by extracting the nickel from the first raffinate, using the same extraction agent to form a second aqueous raffinate containing the cobalt value, substantially free from copper value, and an organic phase comprising the nickel value. The two organic phases can be stripped utilizing a weak acid solution. A more complete exposition of the various extraction agents utilized for separating the copper and nickel from cobalt is shown, for example, in U.S. Pat. No. 3,894,139, which can be utilized in the present procedure.

Preferred examples of certain advantageous embodiments of the procedures in accordance with the present invention are set forth in the accompanying drawings wherein.

Figure 1:
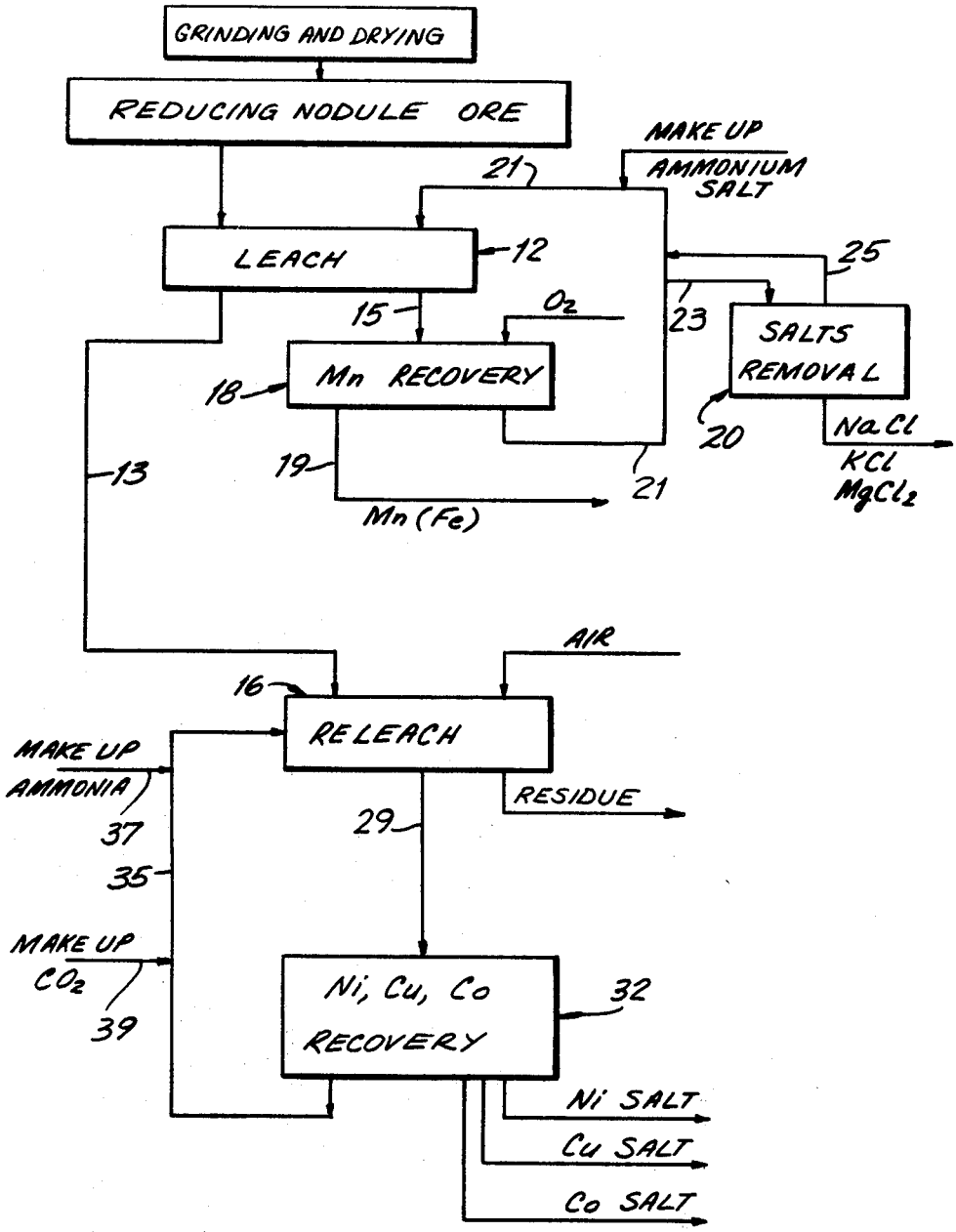
FIG. 1 is a schematic view of a flow diagram of a system for obtaining the substantially complete separations of the metal values found in manganese nodule ores.

In the drawings, and in the following description of the processes, the elements of the apparatus and the general features of the procedure are shown and described in highly simplified form, and generally in an essentially symbolic manner. Appropriate structural details and parameters for actual operation are readily known and understood by those skilled in the art and are not set forth in the description or the drawings, but are included in the specific examples set forth below. Generally, all process vessels and fluid conduits can be of conventional construction and materials suitable for the particular reagents and products to be contained in accordance with the present process.

Referring to FIG. 1, manganese nodule ore is crushed and dried, then ground to a particle size preferably not greater than about 20 mesh and optimally not greater than about 50 mesh, U.S. sieve sizes. The dried ore particles are then treated with a reducing agent, for example a solid carbon-containing material, such as coke or coal, or a gaseous material, such as carbon monoxide, hydrogen, or a mixture thereof, at a temperature of at least about 350° C., in order to reduce the tetravalent manganese to divalent manganese and to reduce the cobalt, copper and nickel values present in the ore. The reduction is carried out until the ore is in a state at which substantially all of the aforesaid four metal values can be leached from the reduced ore utilizing first an ammonium salt solution followed by an ammoniated ammonium salt solution. The reduced nodules are removed from the reduction reactor and permitted to cool to below 100° C., and then admixed with a first releaching solution comprising an aqueous solution of an ammonium salt. The leaching can be carried out in a single large tank reactor or in a plurality of smaller reactors. Both of these situations as well as any other method for contacting the leaching liquid with reduced nodule ore are encompassed within the portion indicated by the numeral 12. The solid, separated from the pregnant leach liquid, is passed via conduit means 13 to the releach stage 16. The pregnant leach liquid passes via conduit 15 to a manganese recovery system 18, where oxygen is passed through the liquid, for example by the bubbling of air through the solution in a tank, so as to form an oxidic precipitate of the manganese and iron values.

The oxidic manganese and iron precipitate is separated, as by filtration, from the liquid and is removed via conduit means 19. The leach liquid, which is regenerated by the precipitation of the manganese to substantially its original concentration of ammonium salt, is recycled via conduit 21 back to the leach stage 12.

It has been recognized that the manganese nodule ore contains a variety of soluble metal values, especially including the alkali and alkaline earth metals, such as sodium, potassium, and magnesium. In order to prevent the build-up of such materials in the leaching liquid, a minor portion of the leaching liquid passing through the recycle conduit 21 is bled-off through bleed stream 23 and passed to a salt removal stage 20, wherein the bleed stream is evaporated and the salts therein crystalized. The crystalized salts are continued to be heated until the ammonium salt is decomposed and passes off overhead through an ammonium salt conduit 25 from which it is condensed and remixed into the recycle conduit 21. As needed, additional makeup ammonium salt can be fed into the recycle stream 21.

The leached reduced ore residue passing through conduit means 13 into releach stage 16 is contacted with the releach solution comprising the ammoniated aqueous solution of the ammonium salt. The contact between the ore solids and the releaching solution can be in a single tank stage or can be countercurrently in a series of contact stages. In any event, air, or other oxygen-containing oxidizing gas is passed through the releaching solution while it is in contact with the ore solids in order to ensure that substantially all of the nickel, cobalt and copper in the ore solids have been oxidized to the soluble valence level. In a multistage contact procedure, the air can be passed into the solution only in the last or the last several stages, if desired. The ore residue is again separated from the releach solution and can be discarded. The releach solution is passed from the releaching stage through conduit 29.

The releach liquid in the nickel, cobalt, copper recovery stage 32 is then treated, for example, by liquid ion exchange extraction, so as to remove the nickel, copper and cobalt values from the releach liquid, thus regenerating the ammonium salt which is passed through recycle stream 35 and re-used in the releaching stage 16. As required, make-up ammonia 37 and make-up $CO_2$ 39 can be added to the recycle stream 35, as required.

The nickel, copper and cobalt can be separated from the releach liquid in their recovery stage 32, by the liquid ion exchange extraction procedures described above, wherein the nickel and copper are selectively extracted utilizing one of the aforesaid liquid ion exchange reagents, leaving the releach liquid containing the cobalt value, which can then be removed by, for example, sulfide precipitation, regenerating the substantially pure ammonium salt/ammonia releaching liquid. The separated nickel salts, copper salts and cobalt salts can then be further treated as desired, to, for example, form the pure metals.

In the example shown, the initial leach stage 12 utilizes an ammonium chloride leaching solution and the releaching stage 16 utilizes an ammonium carbonate/ammonia releaching solution.

Figure 2:
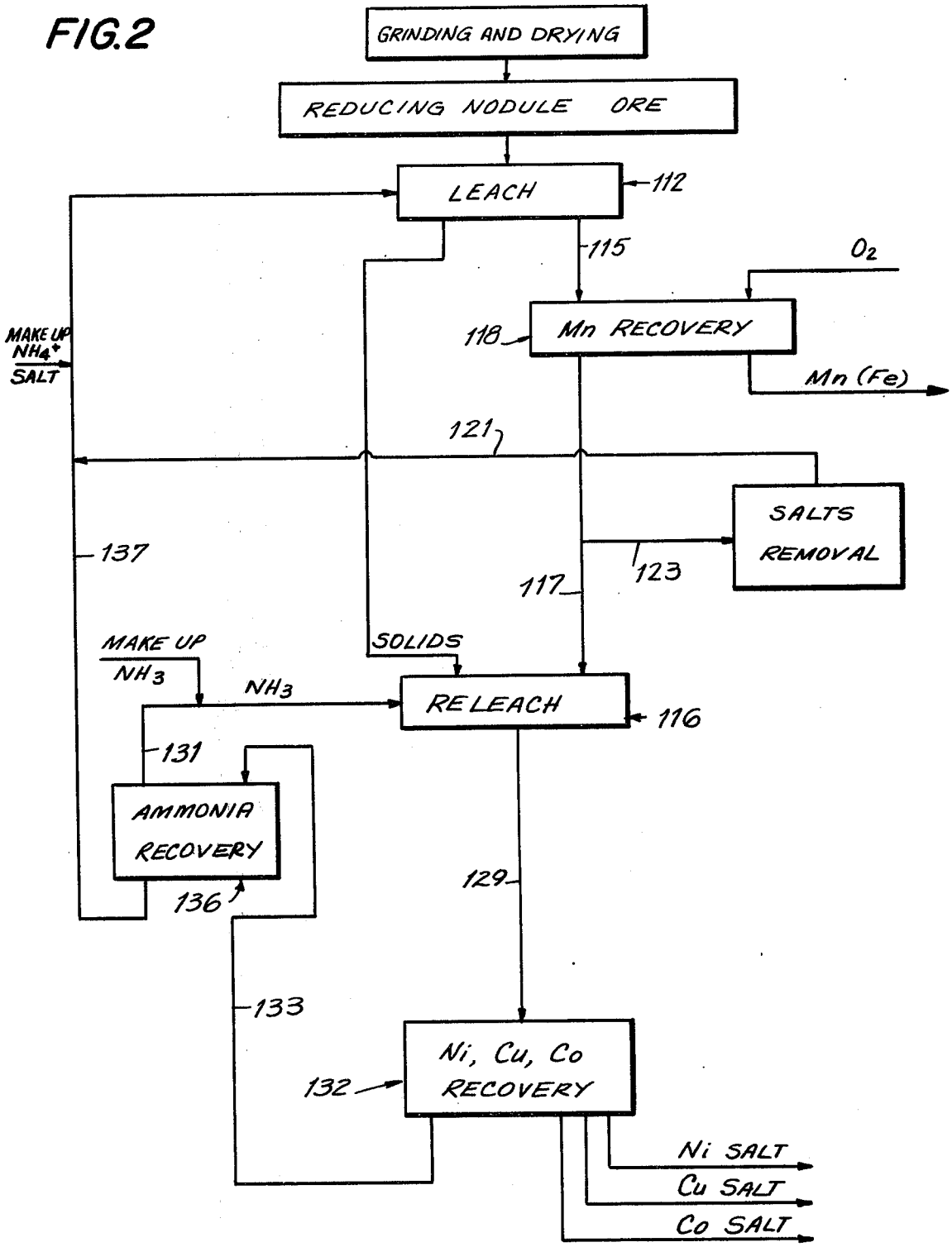
FIG. 2 is a schematic view of a flow diagram of a second preferred system for obtaining the desired metal values.

Referring to FIG. 2, a system is described therein wherein the same ammonium salt is recycled throughout the entire system and utilized for both the leaching solution and the releaching solution.

The nodule ore is ground, dried, and reduced in the same manner as described with regard to FIG. 1, before being placed into contact with the leaching solution in leaching stage 112, wherein the leaching solution comprises ammonium sulfate. After completion of the leaching, the pregnant leach solution is separated from the first reduced ore leach residue, the solution being passed through the manganese recovery conduit 115 to the manganese recovery system 118 where it is aerated to cause the precipitation of manganese and iron hydroxides which are then separated and the reconstituted ammonium salt solution passed out through the releaching liquid line 117. The ammonium salt solution is passed through the releaching line 117 to the releaching stage 116, where it is admixed once again with the leached reduced ore solid residue and ammonia. Alternatively, the ammonium sulfate solution can be premixed with ammonia prior to introduction into the releaching stage 116.

Upon completion of the releaching, the pregnant releach liquid is separated from the solid ore residue which can then be discarded via residue line 109 and the releach liquid passed through the releach conduit 129 to the nickel, copper, cobalt recovery stage 132 where it is treated, for example, in the manner set forth above with regard to FIG. 1 to remove the nickel, copper and cobalt values in the form of salts and the thus regenerated ammonium salt/ammonia solution is then passed through the recovery conduit 133 to an ammonia recovery stage 136 where it is boiled to remove substantially all of the ammonia through overhead ammonia recycle conduit 131. The ammonia overhead from the $NH_3$ removal stage 136, as well as any additionally needed make-up ammonia, is passed into the ammonia recycle line 131 and then to the releaching stage 116 for remixture with the releaching solution. The deammoniated ammonium salt solution is passed from the ammonia recovery stage 136 and recycled to the leaching stage 112 via recycle conduit 137. Additional make-up ammonium salt can be added to the recycle conduit 137 as needed to replenish the ammonium salt prior to leaching.

As explained above, with regard to FIG. 1, a bleed-stream 123 removes a minor proportion of the reconstituted ammonium salt solution from the manganese recovery stage 118. The bleed stream is evaporated and any ammonium salt present therein decomposed and passed overhead back to the recycle stream 137 through overhead conduit 121.

Figure 3:
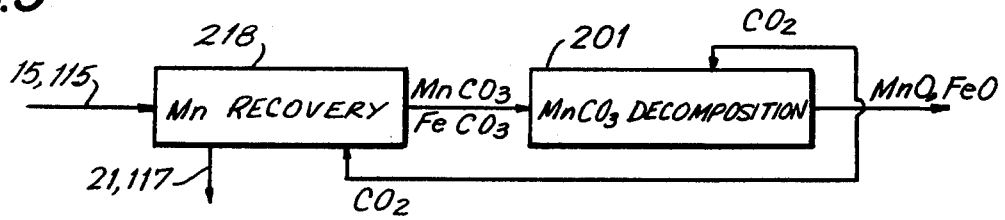
FIG. 3 is a schematic view of a flow diagram of yet a third system for obtaining the desired metal values from manganese nodule ores.

Now, referring to FIG. 3, an alternative manganese recovery system is shown wherein the manganese value is precipitated as manganese carbonate. Carbon dioxide is passed into the manganese-rich pregnant leach solution in the manganese recovery stage 218 so as to cause the precipitation of substantially all of the manganese value as manganese carbonate. The reconstituted ammonium salt solution, e.g., ammonium sulfate, is separated from the precipitate and recycled to the leaching stage, as in FIG. 1, or passed to the releaching stage, as in FIG. 2. The solid manganese carbonate is decomposed in a kiln 201 to manganese oxide and carbon dioxide, which is then recycled back to the manganese recovery stage 218. The manganese carbonate precipitate is generally initially dehydrated to form the anhydrous salt which is then decomposed in a manner well known to the art to form manganese oxide dioxide.

The following examples include preferred embodiments of the procedures carried out in accordance with the process of the present invention. The various process steps set forth in the following working examples, and in the aforedescribed drawings, are intended to be merely exemplary of the present invention and do not limit the scope thereof, which encompasses procedures as broadly defined above and all equivalents thereof.

EXAMPLE 1

A sample of an ocean floor nodule ore (containing 15.2% manganese, 10.2% iron, 0.54% nickel, 0.28% cobalt, and 0.09% copper, having been ground to a particle size of not greater than about 100 mesh U.S. sieve scale, i.e. 50 grams of the ore, is placed into a 2.5" Vycor tube and placed into a furnace. The tube and the contents are initially purged with nitrogen at a rate of 150cc/minute while the furnace is being heated to a temperature of about 450° C. When the operating temperature is reached, the nitrogen purge is closed off and the kiln was manually rotated 180° and back every five minutes while 300ml/minute of a dilute carbon monoxide (50 volume % CO and 50 volume % $N_2$) were injected into the kiln for a total time of 75 minutes.

Following completion of the reduction reaction, the reduced ore was cooled and discharged into a 200 milliliter centrifuge bottle containing 175ml ammonium carbamate solution (260 grams/liter $NH_3$ _ 150 grams/liter $CO_2$), stoppered and rotated for 1 hour at 25° C. Following subsequent centrifugation, the supernatant liquid was quickly decanted into a sample bottle which was then capped. The remaining solids were then admixed with 150 milliliters of additional fresh ammonium carbamate solution, rotated for an additional hour at 25° C., centrifuged and the supernatant liquid decanted. The two supernatant liquids were combined and the combined solution analyzed for dissolved metal values.

A second sample of the dried and ground ore, but without reduction, is treated with the ammonium carbamate solutions in the same manner as described above. The ammonium carbamate solutions are combined and analyzed for dissolved metal values.

The combined liquid solution obtained from the reduced ore material contained the following percentages of the metal values present in the leached ore: manganese - 78.3% by weight, iron - 78% by weight, nickel - 92.2% by weight, and cobalt - 81% by weight. The supernatant leached liquid obtained from the non-reduced ore was found to contain substantially no metal values, other than the undesirable alkali and alkaline earth metals. Accordingly, it has been shown that the reduction of the ore is necessary before any substantial leaching of the metal values can be obtained utilizing an ammoniated leach solution.

EXAMPLE 2

A further sample, 50 grams, of the ground ore of Example 1 was reduced in a hydrogen gas atmosphere for a period of sixty minutes at 560° C. The reduced ground ore was cooled and admixed with 250 milliliters of an ammonium sulfate solution (215 g/liter) in a centrifuge bottle which was then rotated for one hour at a temperature of between 86 and 90° C. The solution was then centrifuged and the supernatant liquid quickly decanted into a sample bottle and capped. The decanted liquid was then analyzed for metal values, and it was found that the following percentages of the total metal values present in the nodule ore were leached into the ammonium sulfate solution: 70% manganese, 17% nickel, 8% cobalt, less than 5% copper, and 4% iron. A second leaching of the leached ore residue with fresh ammonium sulfate solution results in the extraction of substantially the remaining quantity of manganese without any substantial further leaching, or extraction, of the remaining metal values.

Upon passing air through the leach solution, at substantially room temperature, an oxidic precipitate of substantially all of the manganese value, as manganese oxide, was formed, which can be readily separated from the remaining aqueous solution. Upon reanalysis of the remaining aqueous solution, it was found that substantially all of the dissolved iron was precipitated out, together with the manganese and separated from the aqueous solution, probably as ferric hydroxide.

The leached ore subsequent to the leaching with ammonium sulfate, was next contacted with 250 milliliters of releaching solution solution containing 267 grams per liter of ammonia and 163 grams per liter of $CO_2$ (ammonium carbamate and hydroxide), at from 25 - 30° C. The contact was again made in a single stage centrifuge bottle and the bottle rotated for 60 minutes. The mixture of reduced ore and aqueous leach solution was then centrifuged and the supernatant liquid decanted into a sample bottle.

The releach solution is analyzed for the remaining metal values and the following percentages of the metal values in the reduced ore were found to have been dissolved into the pregnant releach solution: 50% nickel, 40% cobalt, and 60% iron.

EXAMPLE 3

An ammoniacal carbonate solution, of the type obtained by the leaching of a reduced manganese nodule ore, was prepared by forming a leaching solution by admixing 150 ml. concentrated $NH_4OH$ to give a total volume of 250 ml. This dilute ammonium hydroxide solution was mixed with 250 grams of ammonium carbonate, and the resulting solution contacted with a mixture of copper, nickel and cobalt metals to give a solution containing 7500ppm copper, 6250ppm nickel and 600ppm cobalt. The solution after the leaching had a pH of 9.4. The solution was next subjected to liquid ion exchange in accordance with this process to obtain a separation of the three metal values.

The liquid ion exchange solution was an organic, water-insoluble solution comprising 5% by volume of a 7-hydrocarbon-substituted-8-hydroxyquinoline (Kelex 100), 5% isodecanol and 90% aromatic hydrocarbon solvent (Napoleum 470).

The leach solution prepared above was contacted with an equal volume of the above-described organic liquid ion exchange solution in a mixing vessel. The mixed liquids were then permitted to settle and the upper, organic layer decanted. The lower aqueous solution, raffinate, was then contacted with a second equal volume of fresh liquid ion exchange solution according to the same procedure as above and again the organic and aqueous layers were separated. A third contact, with fresh, organic, liquid ion exchange solution, was made with the aqueous raffinate from the second contact. The aqueous raffinate after each of the three contacts were analyzed and the amounts of copper, nickel and cobalt values remaining therein were determined and are set forth in the following table:

Table 1

| | Copper (ppm) | Nickel (ppm) | Cobalt (ppm) |
|---|---|---|---|
| Feed solution | 7,500 | 6,250 | 600 |
| After 1st Contact | 4,000 | 6,000 | 600 |
| After 2nd Contact | 900 | 5,850 | 600 |
| After 3rd Contact | 0 | 3,250 | 600 |

As shown from the above table, the copper can first be readily separated from the nickel and cobalt, and in a subsequent series of contacts nickel can be readily separated from the cobalt leaving the cobalt substantially undisturbed in the aqueous final raffinate. The nickel can be stripped from the organic liquid ion exchange solution by a weak acid solution, for example having a pH of about 2.

The patentable embodiments of the invention which are claimed are as follows:

1. A process for selectively removing metal values from a manganese nodule ore, the ore comprising a primary proportion of manganese and iron and secondary proportions of nickel, copper and cobalt, the weight ratio of manganese : iron being at least about 5:1 and the total combined amounts of copper and nickel being at least abour 1.5% by weight of the nodule ore, the process comprising:

(a) comminuting the ore to a particle size of not greater than about 20 mesh;

(b) reducing the comminuted ore, at a temperature in the range of from about 300 to about 850° C., in the presence of a reducing agent selected from the group consisting of carbonaceous materials and hydrogen, such that the manganese, nickel, cobalt and copper values are reduced to a condition in which the metal values are leachable by ammoniacal ammonium salt solutions;

(c) leaching the reduced ore with an aqueous leaching solution of an acidic ammonium salt, the ammonium salt being present in an amount in the range of from about 80% to about 120% by weight of the stoichiometric amount to react with all of the manganese value in the ore, so as to obtain an aqueous pregnant leach solution comprising dissolved manganese salt and a first solid residue comprising the remaining nickel, copper and cobalt salts;

(d) oxygenating the pregnant leach solution to form an oxidic precipitate comprising the manganese and any iron values present in the pregnant leach solution; and separating the oxidic precipitate from the aqueous solution to regenerate the aqueous leaching solution of an acidic ammonium salt substantially free of dissolved manganese and iron;

(e) ammoniating the regenerated aqueous leaching solution to form an ammoniacal basic releaching solution of the ammonium salt wherein the concentration of ammonia is at least about 0.5 molar and wherein the concentration of the ammonium salt is at least about 0.2 Normal; and (f) releaching the first solid residue with the ammoniacal basic releaching solution to form an aqueous pregnant releach solution of nickel, copper and cobalt soluble salts and a second solid residue.

2. The process of claim 1, comprising removing ammonium hydroxide from the ammoniated ammonium salt solution so as to form an ammonium salt solution and free ammonia, the ammonium solution being recycled to contact reduced nodule ore and the ammonia being recycled and passed into the releaching liquid in contact with the first solid residue.

3. A process for selectively removing metal values from a manganese nodule ore, the ore comprising a primary proportion of manganese and iron and secondary proportions of nickel, copper and cobalt, the weight ratio of manganese: iron being at least about 5:1 and the total combined amounts of copper and nickel being at least about 1.5% by weight of the nodule ore, the process comprising:

(a) comminuting the ore to a particle size of not greater than about 20 mesh;

(b) reducing the comminuted ore, at a temperature in the range of from about 300 to about 850° C., in the presence of a reducing agent selected from the group consisting of carbonaceous materials and hydrogen, such that the manganese, nickel, cobalt and copper values are reduced to a condition in which the metal values are leachable by ammoniacal ammonium salt solutions;

(c) leaching the reduced ore with an aqueous leaching solution of an acidic ammonium salt, the ammonium salt being present in an amount in the range of from about 80% to about 120% by weight of the stoichiometric amount to react with all of the manganese value in the ore, so as to obtain an aqueous pregnant leach solution comprising dissolved ammonia and manganese salt, without the evolution of substantial quantities of free ammonia, and a first solid residue comprising the remaining nickel, copper and cobalt salts;

(d) oxygenating, without adding other reagent to, the pregnant leach solution to form an oxidic precipitate comprising the manganese, and any iron, values present in the pregnant leach solution to regenerate the aqueous leaching solution of an acidic ammonium salt substantially free of dissolved manganese and iron and separating the oxidic precipitate from the regenerated aqueous leaching;

(e) recycling the regenerated aqueous leaching solution to leach additional reduced and comminuted ore; and (f) releaching the first solid residue with an ammoniacal basic releaching solution of an ammonium salt wherein the concentration of ammonia is at least about 0.5 molar and wherein the concentration of the ammonium salt is at least about 0.25 Normal to form an aqueous pregnant releach solution of nickel, copper and cobalt soluble salts and a second solid residue.

4. The process of claim 3, wherein the amount of ammonium salt in the leaching solution is in the range of from about 90% to about 110% of the stoichiometric amount required to react with all of the manganese value in the ore.

5. The process of claim 3, wherein the solid leached ore is simultaneously aerated and releached.

6. The process of claim 3, wherein the ammonium salt in the releaching solution is selected from the group consisting of ammonium sulfate, ammonium chloride, ammonium carbonate and ammonium nitrate.

7. The process of claim 3, wherein the nodule ore is reduced at a temperature in the range of from 300 to about 850° C.

8. The process of claim 7, comprising in addition, drying the nodule ore prior to reduction.

9. The process of claim 8, wherein the nodule ore is dried at a temperature in the range of from about 150° C. to about 250° C.

10. The process of claim 9, wherein the nodule ore is reduced by being reacted with a reducing agent selected from the group consisting of a carbonaceous reducing agent and a hydrogen-containing reducing agent.

11. The process of claim 10, wherein the carbonaceous reducing agent is selected from the group consisting of carbon, hydrocarbon compounds and carbon monoxide.

12. The process of claim 3, comprising in addition extracting the nickel, cobalt and copper values from the pregnant releach solution so as to regenerate the ammoniated ammonium salt releaching solution.

13. The process of claim 12, wherein the regenerated ammoniated ammonium salt releaching solution is recycled and used to releach additional first solid residue.

14. The process of claim 12, comprising contacting the pregnant releach solution with an organic water-immiscible, liquid ion exchange extracting medium comprising an extracting agent selected from the group consisting of alpha-hydroxyoximes and 7-hydrocarbon-substituted-8-hydroxyquinolines so as to selectively extract copper, forming an organic phase containing the copper value, substantially free of cobalt and nickel values, and contacting the first raffinate with a second organic, water-immiscible, liquid ion exchange medium comprising an extracting agent selected from the aforesaid group so as to selectively extract nickel, forming a second organic phase containing the nickel value and a second aqueous raffinate containing the cobalt value.

15. The process of claim 14, wherein the pH of the releach solution is at least about 9.

16. The process of claim 14, wherein the pH of the releach solution is in the range of from about 9 to about 10.

* * * * *

UNITED STATES PATENT AND TRADEMARK OFFICE

CERTIFICATE OF CORRECTION

PATENT NO. : 4,137,291

DATED : Jan. 30, 1979

INVENTOR(S) : PAUL H. CARDWELL, Zanoni; WILLIAM S. KANE, Wicomico, both of Va.

It is certified that error appears in the above-identified patent and that said Letters Patent are hereby corrected as shown below:

IN THE CLAIMS:

Column 14, line 37, "abour" should read --about--.

Signed and Sealed this

First Day of May 1979

[SEAL]

*Attest:*

RUTH C. MASON
*Attesting Officer*

DONALD W. BANNER
*Commissioner of Patents and Trademarks*